United States Patent [19]

Fischer

[11] 4,442,681

[45] Apr. 17, 1984

[54] ICE-MAKER

[76] Inventor: Harry C. Fischer, P.O. Box 1687, Cocoa, Fla. 32922

[21] Appl. No.: 306,219

[22] Filed: Sep. 28, 1981

[51] Int. Cl.[3] ..... F25C 1/12

[52] U.S. Cl. ..... 62/347; 62/348; 62/352

[58] Field of Search ..... 62/515, 347, 348, 351, 62/352, 73, 74; 165/162, 172

[56] References Cited

U.S. PATENT DOCUMENTS

| | | | |
|---|---|---|---|
| 150,477 | 5/1874 | Martin | 62/74 |
| 882,224 | 3/1908 | Williams . | |
| 1,697,600 | 1/1929 | Jack | 165/172 |
| 1,852,363 | 4/1932 | Parent | 165/172 X |
| 1,966,150 | 7/1934 | Tamm | 62/347 X |
| 1,998,575 | 4/1935 | Furnas . | |
| 2,495,378 | 1/1950 | McCabe . | |
| 2,567,716 | 9/1951 | Kritzer | 165/162 X |
| 2,821,070 | 1/1958 | Watt et al. | 62/348 X |
| 2,997,861 | 8/1961 | Kocher et al. | 62/348 X |
| 3,043,117 | 7/1962 | Bollefer | 62/348 X |
| 3,206,944 | 9/1965 | Gallo . | |
| 3,648,477 | 3/1972 | Shartle | 62/351 X |
| 3,759,048 | 9/1973 | Cochran . | |
| 3,913,349 | 10/1975 | Johnson | 62/348 X |
| 4,177,816 | 12/1979 | Torgeson | 165/172 X |
| 4,255,941 | 3/1981 | Bouloy . | |

FOREIGN PATENT DOCUMENTS 1156092 3/1959 Fed. Rep. of Germany .

*Primary Examiner*—William E. Tapolcai

*Attorney, Agent, or Firm*—Fitch, Even, Tabin & Flannery

[57] ABSTRACT

An ice-maker for making generally half-round pieces which includes a pair of evaporator assemblies, a compressor, a condenser and a receiver for liquid refrigerant. The ice-maker is operated so that a film of water is supplied to one evaporator which is being cooled to form ice cubes while ice cubes are being harvested from the other evaporator. The evaporator assembly includes a stainless steel evaporator coil formed to provide parallel segments, plus support means of injection-molded plastic, which provides a central, planar web aligned with said tubing segments, plus transverse dividers which define the individual cube-forming regions. Low voltage power can be selectively applied to the evaporator coil to harvest the ice pieces via resistance heating, or warm water can be pumped through hollow passageways in the dividers.

4 Claims, 17 Drawing Figures

119
121a
125
119
R
117a
121a 111
113
109
P
113
101
107
103
115
105
105

127
119
11.
133
137
133
137
121a
11.
135
119
121b

103

125
127
10.
121a
117a
117b
119
B
119
A 121a
121a
121b
10.
121b
123
121a
121b
139
123

133
137
129
119
137
137

Fig. 13.
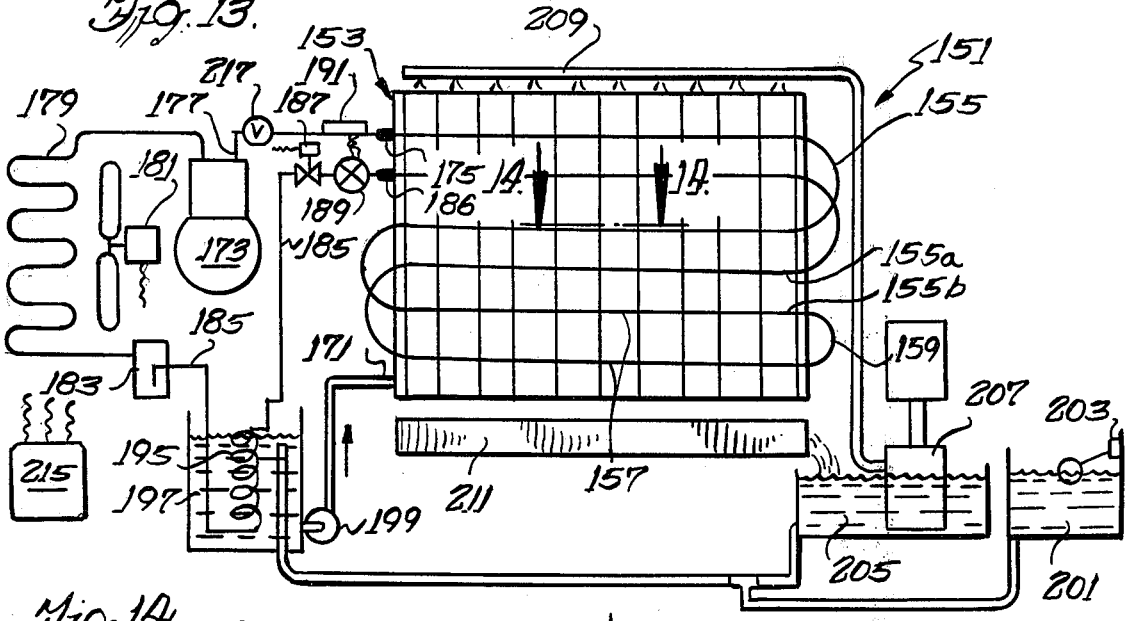
Fig. 14.
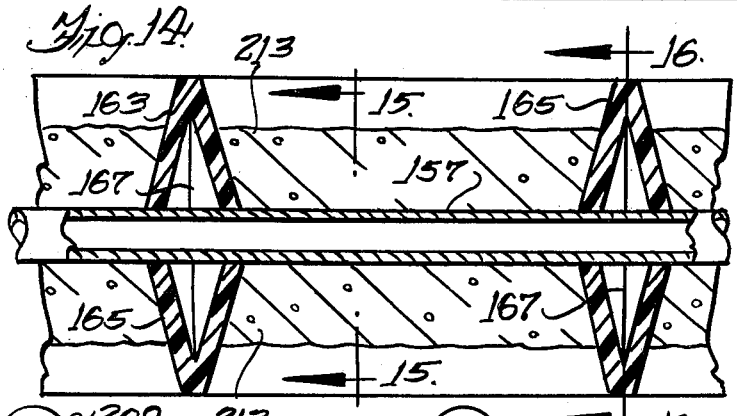
Fig. 17.
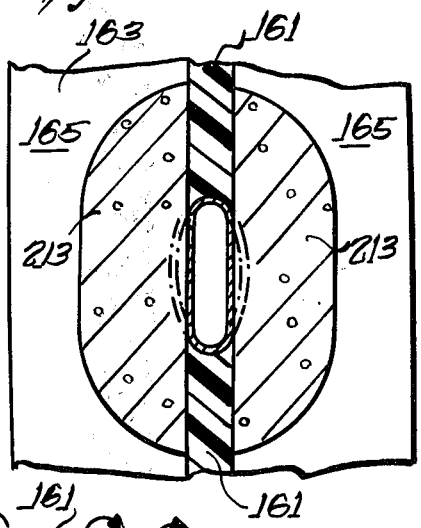
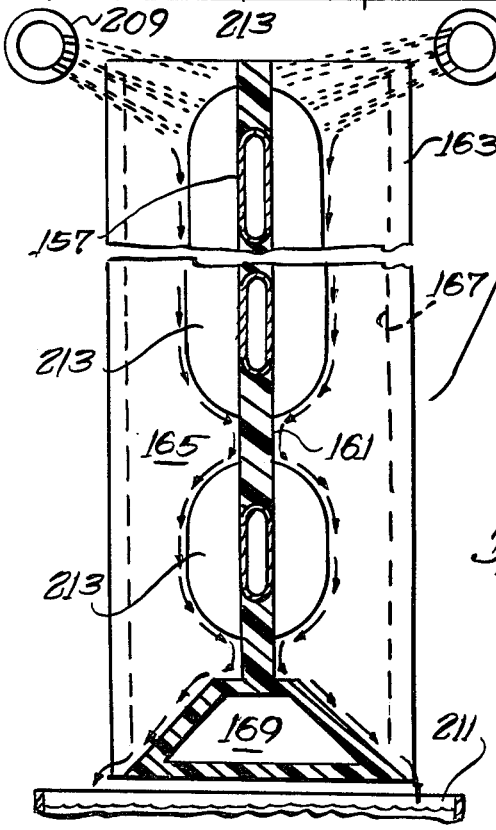
Fig. 15.
Fig. 16.
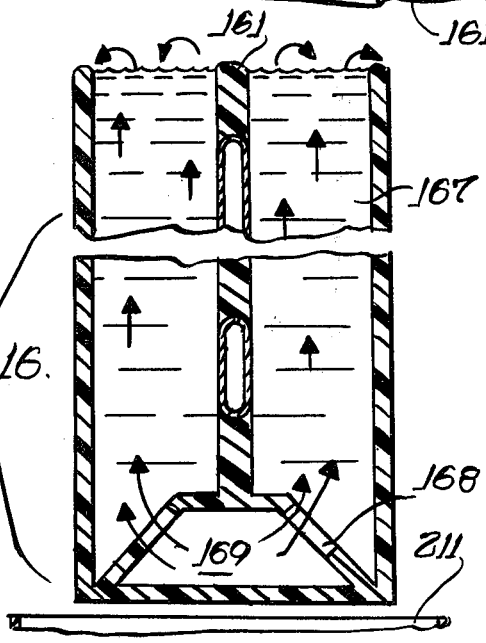

ICE-MAKER

BACKGROUND OF THE INVENTION

This invention relates to ice-making and more particularly to ice-makers for producing individual pieces of ice from water having a generally half-round shape. There have been machines for making individual pieces of ice for a number of years which either form the pieces individually or form them with some type of interconnections that are subsequently broken to provide individual pieces suitable for use in a beverage or the like. Although these pieces may have different shapes than that of a geometric cube, they are commonly referred to as ice cubes.

In most of these ice-makers, the evaporator has employed a coil of copper and has been relatively expensive to produce, and also the hot gas exiting from the refrigerant compressor has been employed to harvest the ice cubes after freezing has been completed. Such a harvesting operation has resulted in melting a substantial amount of the ice already frozen, thus reducing the output of the ice-maker and contributing to poor overall energy efficiency. Because of the added energy consciousness that has become prevalent throughout the world within the past few years, improvements in ice-makers to make them more efficient become particularly desirable.

BRIEF SUMMARY OF THE INVENTION

An ice-maker is provided which utilizes a pair of evaporator assemblies of improved design that operate alternately so that one is freezing ice cubes while the other is harvesting. Harvesting may be carried out by utilizing low-voltage, electrical resistance heating to release the ice as individual cubes while minimizing the amount of heat needed to accomplish harvesting. Also harvesting may be carried out by pumping warm water through hollow passageways in the assemblies. The individual evaporator assemblies each include metal tubing formed to provide a plurality of parallel, serially interconnected segments. They may be clamped between a plurality of specially molded blocks of synthetic resin through which stablizing metal rods are carried which are electrically heated to effect the harvesting operation, or they may be molded permanently in synthetic resin using injection-molding or the like.

BRIEF DESCRIPTION OF THE DRAWINGS

FIG. 13 is a diagrammatic view of another alternative embodiment of an ice-maker embodying various features of the present invention;

FIG. 14 is an enlarged sectional view of the evaporator shown in FIG. 13 taken horizontally generally along the lines 14—14 of FIG. 13;

FIGS. 15 and 16 are vertical sectional views taken generally along the lines 15—15 and 16—16 of FIG. 14; and FIG. 17 is an enlarged fragmentary view showing an ice "cube" in place on the evaporator and showing the deformation of the tubing, in dotted lines, which occurs to assist harvesting.

DETAILED DESCRIPTION OF THE PREFERRED EMBODIMENTS

Figure 1:
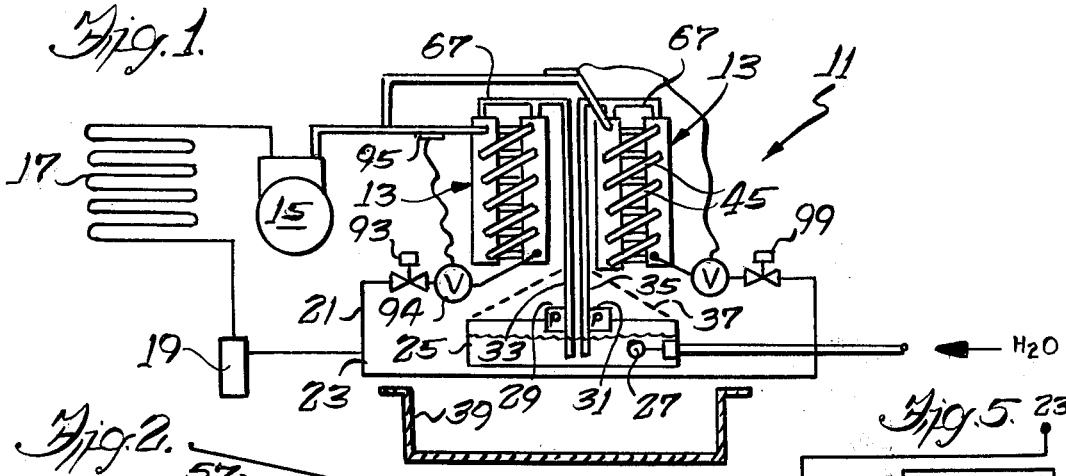
FIG. 1 is a diagrammatic view of an ice-maker embodying various features of the present invention.

Illustrated diagrammatically in FIG. 1 is an ice-maker 11 which includes a pair of side-by-side evaporator assemblies 13. The ice-maker 11 is designed so that the evaporators operate alternately with one evaporator freezing ice cubes while the other evaporator is being harvested. Depending upon the overall design and the timing, one or two additional evaporators might also be included. Because of the overall design, harvesting can be accomplished during the relative long period of time it takes to freeze the ice cubes on the other evaporator, and thus electrical low-voltage heating can be used and is easily adjustable to effect harvesting slowly without overheating. This not only conserves the amount of energy used, but it also avoids raising the temperature of the evaporator higher than necessary—realizing that the higher the temperature of the evaporator reaches during harvesting, the more cooling will be required during the next freezing or ice-making cycle.

In addition to the two evaporator assemblies 13, the ice-maker 11 includes a compressor 15 which takes its suction from the evaporators and a condenser 17 which cools the high-pressure refrigerant vapor to produce a high-pressure liquid refrigerant. A receiver 19 collects the liquid refrigerant from the condenser 17 and supplies it through a pair of lines 21,23 leading to the lower end of each evaporator.

A water reservoir 25 is provided vertically below the evaporators wherein a desired level is maintained by a float valve 27 or the like. A pair of pumps 29,31 driven by electrical motors take water from the reservoir and supply it through a vertical tube 33,35 to the top of each evaporator assembly 13. The water is distributed across each evaporator assembly and flows downward as a film, with the excess being returned to the reservoir by dripping through a wire screen 37 which covers the top of the reservoir. Sediment or the like is removed from the reservoir 25 by draining a small amount of water to waste from the bottom thereof by a suitable device (not shown). The harvested ice cubes fall from the evaporator assembly, slide down the inclined screen and are collected in an underlying collection chamber or bin 39.

Figure 2:
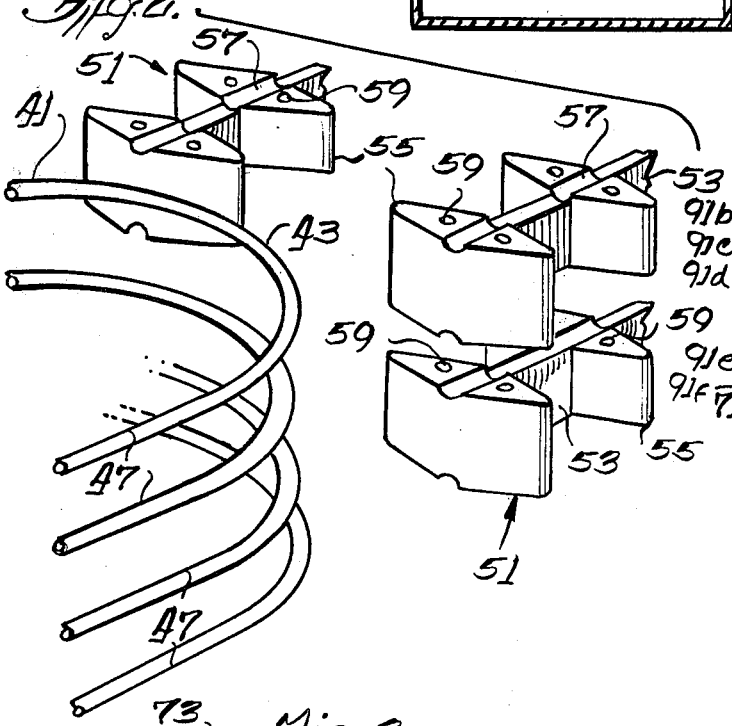
FIG. 2 is an exploded fragmentary perspective view illustrating particular details of the evaporator assembly which appears in the FIG. 1 embodiment.
Figure 6:
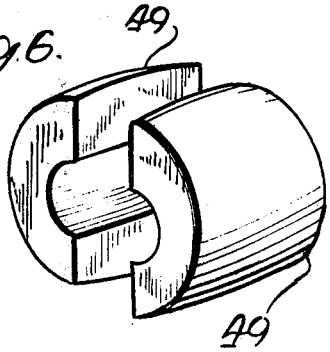
FIG. 6 is an enlarged perspective view showing the half-round ice pieces which are produced by the ice-maker of FIG. 1.
Figure 3:
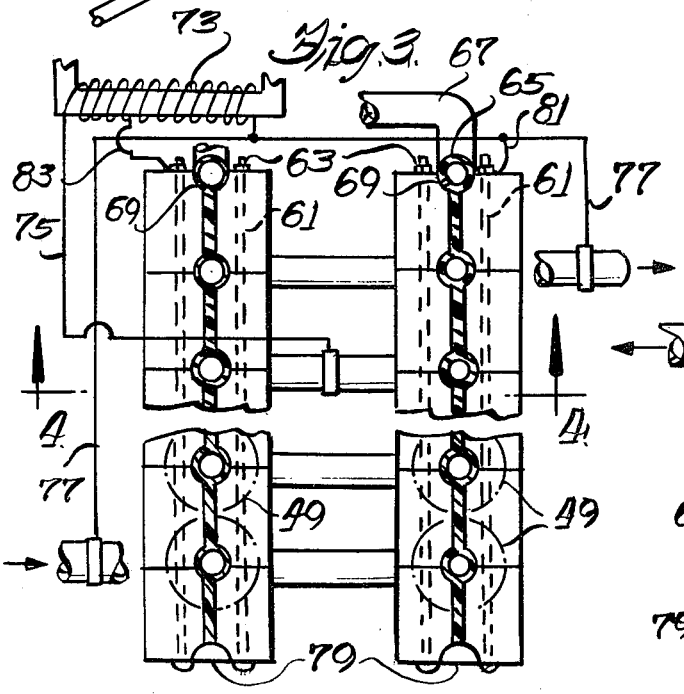
FIG. 3 is a vertical sectional view taken through the evaporator assembly of the FIG. 1 embodiment.

As best seen in FIGS. 2 and 3, each evaporator assembly 13 is made up of a single length of stainless steel tubing 41 which has been bent to form a coil having a plurality of U-shaped sections 43, which sections are interconnected at their near end (FIG. 1) by the short diagonal sections 45. Each of the U-shaped sections 43 provides two parallel tubular segments 47 which provide the freezing surface for the build-up of ice cubes 49 of half-round shape, as illustrated in FIG. 6. Disposed above and below each of the straight segments 47 of the coil is a longitudinally extending spacer 51 of specific design. As best seen in FIG. 3, the spacers 51 abut one another and are arranged in two parallel stacks in each evaporator assembly 13.

The spacers 51 are made of a synthetic resin or plastic material and may be formed by any suitable shaping method. Preferably, the spacers 51 are economically injection-molded from a plastic material having the desired thermal conductivity, such as high density polypropylene, polytetrafluroethylene (Teflon), high density polyethylene or low-density polyethylene. To facilitate the harvesting by electrical resistance heating, the spacers 51 are preferably fabricated from a synthetic resin material having a thermal conductivity between about 0.15 and about 1.10 Btu/ft/hr/° F. Other molding processes might also be used depending upon the particular synthetic resin chosen.

Each of the spacers 51 includes a central longitudinal web 53 which extends for the entire length of the spacer and which web has a thickness slightly less than the outer diameter of the stainless steel tubing 41 from which the coil is formed. Longitudinally spaced along the webs 53 of each spacer are pairs of generally triangular-shaped dividers 55 which extend in opposite directions from the vertical surfaces of the webs. The spacing between the adjacent dividers 55 determines the length of the ice cubes 49 which will be formed, as depicted in FIG. 6.

A groove 57 of generally semi-circular cross section is provided in the upper and the lower surfaces of each spacer 51, with the groove 57 being proportioned to receive the straight segment 47 of the coil tubing. Each of the dividers 55 contains a vertical hole 59 in a precise location, which holes in the assembled stack are aligned with one another to provide a vertical passageway through which a metal stabilizing rod 61 is passed. The metal rods 61 are preferably threaded at the upper ends, and fasteners 63, such as nuts, are employed to hold the spacers in the stacked assembly and clamp the straight line segments 47 of the evaporator coil between adjacent upper and lower spacers, as best seen in FIG. 3.

Shown in ghost outline in FIG. 3 are half-round ice cubes 49 in the locations where they will form by growing outward from the exposed surfaces of the tubing segments 47 in the individual regions between the longitudinally spaced dividers 55. To facilitate the release of the cubes from the evaporator, the surfaces of the divider 55 are preferably formed at an angle A (FIG. 4) to the web 53 which is at least about 95° and preferably between about 100° and 120°.

The uppermost groove 57 in each stack of spacers contains a water distributor pipe 65 to which water is supplied via a header 67. The water distribution pipes 65 have a series of holes 69 along the length thereof designed to supply water to the webs of the spacers where it will flow downward as a film over the exposed sections of the coil tubing, with the excess dripping through the screen 37 back to the reservoir. Each of the headers 67 serves the two water distribution pipes 65 in each of the evaporator assemblies and is, in turn, supplied through one of the uptake lines 33,35 by one of the pumps 29,31. If desired, a single pump can be employed with a solenoid-operated switching valve which may allow the pump to run continuously whenever the ice-maker is operating and supply water to whichever of the two evaporator assemblies is presently in the ice-making cycle.

The harvesting operation is carried out by using low-voltage resistance heating to heat the respective evaporator assembly 13 to free the surfaces of the half-round ice pieces 49 from the exposed surface of the tubing segment and the surfaces of the spacers 51. The low voltage current is preferably supplied from the secondary winding of a transformer 71 to both the metal rods 61 and to the evaporator coil 41. The secondary winding 73 of the transformer 71 is depicted in FIG. 3, and electrical connections are made from one end of the winding via a lead 75 to a connector ring at a central location approximately midway between the two ends of the evaporator coil 41. The other end of the winding 73 is connected via suitable leads 77 to clamping rings attached to the inlet to the evaporator coil and attached to the outlet from the evaporator coil. This arrangement creates a current flow between the center portion of the coil and both ends and provides the desired amount of resistance heating of the evaporator coil to effect the surface melting.

Figure 4:
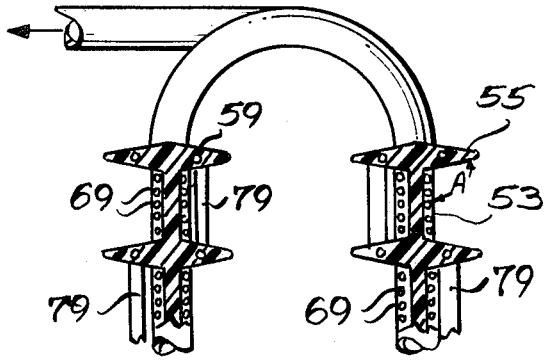
FIG. 4 is a horizontal sectional view taken generally along the line of 4—4 of FIG. 3.

The metal rods 61 are all connected in series via jumper plates 79 which extend longitudinally at their upper ends, as seen in FIG. 4, and transversely at their lower ends. One end of the series-connected array of metal rods is connected via a lead 81 to the right-hand end of the transformer secondary winding 73, and the other end is connected by a lead 83 to an adjustable tap located along the length of the winding to provide the desired voltage across the array of rods.

Figure 5:
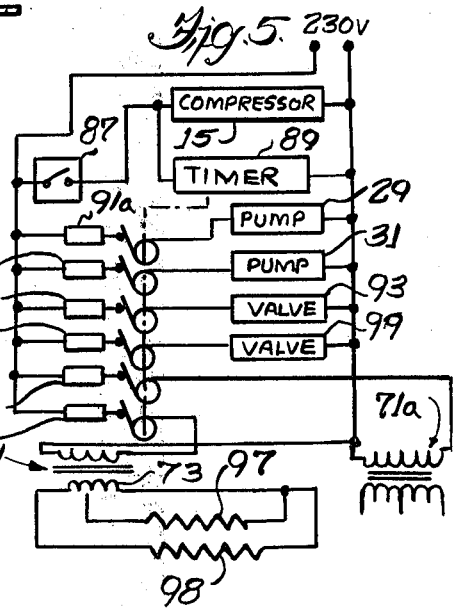
FIG. 5 is an electrical schematic view of the control circuitry for operating the ice-maker of FIG. 1.

FIG. 5 depicts an electrical control panel 85 for the ice-maker 11 which is preferably connected to line voltage of about 230 volts. Normally, the ice-maker includes a starting switch 87 which is associated with the collection bin 39, that causes the ice-maker to operate continuously until such time as the bin is filled with ice cubes to its full condition. Closing of the switch 87 causes the compressor motor to run and also causes a timer 89 to run, which sequentially operates six separate switches 91 that variously cause functioning of the individual components in the desired sequence.

More specifically, the timer 89 first closes the switch 91*a* causing pump 29 to run and supply water from the reservoir to the header 67 leading to the left-hand evaporator in FIG. 1. After the pump has operated for about a minute, the timer closes the switch 91*c* which opens a solenoid valve 93 in the line 21 to supply high-pressure refrigerant through a regulating valve 94 leading to the inlet to the left-hand evaporator coil. The regulating valve 94 is preferably controlled by a thermoprobe 95 attached to the exit from the evaporator. At the time the timer starts the pump 29, it also closes a switch 91*e* to supply power to the primary winding of a transformer 71*a* that is connected to the right-hand evaporator assembly and would thereby begin a harvesting cycle of any ice cubes present on that evaporator assembly. It is noted that, in the illustrated embodiment, a pair of transformers are employed so that one is associated with each of the evaporator assemblies; however, if desired, a single transformer could be used with the timer 89 being employed to effect an electrical switching to alternately connect the secondary winding of the transformer with one and then the other evaporator assembly.

The water supplied by the pump 29 through the header 67 flows through the holes 69 and then downward along all of the segments 47 of the tubing. The high-pressure refrigerant expands through the valve 94 and evaporates within the coil, thus lowering the temperature of the tubing to about 20° F. and causing the water film to slowly freeze about the exposed surface. The thickness of the ice continues to grow toward the configuration shown in FIG. 6 as it slowly grows upward and downward along the web portions 53 of the spacers, with the ends of the half-round pieces 49 being determined by the boundaries provided by the slanting surfaces of the triangular dividers 55. As an example, the ice pieces may have an outer radius of curvature slightly less than a half an inch, an inner longitudinal length of about $\frac{3}{4}$ inch and an outer longitudinal length of about $\frac{7}{8}$ inch.

Although the freezing rate can be increased by increasing the flow of the evaporating high-pressure liquid refrigerant through the evaporator coil 41, it has been found that efficient operation can be effected with a freezing cycle of about fifteen minutes. The timer 89 is used to control the length of the ice-making cycle and can be adjusted as desired, depending upon the surrounding environmental conditions.

When the pre-set time period has elapsed, the timer 89 opens the switch 91*c*, removing power from the solenoid and closing the valve 93 which was permitting supply of high-pressure liquid refrigerant to the lower inlet of the evaporator coil, thus allowing the evaporator to "dry out". Next, the timer opens the switch to the motor of the pump 29, halting the supply of water to the water distribution tubes 65 atop the left-hand evaporator assembly and simultaneously closes the switch 91*f* supplying power to the primary winding of the transformer 71. This causes low-voltage current to flow through the metal clamping rods 61 which are represented by the resistance 97 in FIG. 5, and also through the evaporator coil which is represented by the resistance 98 in FIG. 5. The heat generated by the low-voltage resistance heating raises the temperature of the plastic spacers 51 and the stainless steel tubing from approximately 20° F. to about 32° F., at which temperature the mechanical ice bonds between the plastic and stainless steel are broken by melting.

At the same time as the power is removed from the pump 29, the timer closes the switch 91*b* to provide power to the motor of pump 31 to begin the supply of water to the header 67 at the top of the right-hand evaporator assembly. Shortly thereafter, the timer closes the switch 91*d* applying power to the solenoid which controls and opens the valve 99 in the refrigerant line 23 leading to the lower inlet to the right-hand evaporator assembly to start the ice-making cycle. As the ice-making proceeds on the right-hand evaporator, harvesting is proceeding on the left-hand evaporator, and the operation of the pump motor produces vibrations which assist in freeing the ice cubes from the surfaces of the evaporator assembly as the melting slowly proceeds. Because the cycle is about fifteen minutes in duration, harvesting can be economically carried out via the low-voltage resistance heating for there is a relatively low mass to heat in the evaporator assembly as a result of the large amount of plastic, compared to an all-metal evaporator, and overheating by raising the temperature higher than necessary to free the ice cubes is avoided. Moreover, it has been found to be advantageous to restart the supply of water from the pump about 30 seconds to 1 minute before the beginning of the next ice-making cycle so that the downward flowing water assists in breaking the cubes loose during harvesting. Overall, the ice-maker 11 operates much more efficiently when the compressor 15 is permitted to operate continuously in a refrigerating mode than when it is otherwise forced to operate for a period of a few minutes every fifteen minutes where the hot gas is used to warm the evaporator coil to provide the heat for the harvesting operation.

Depicted in FIGS. 7 through 12 is an alternative embodiment in the form of an ice-maker 101 which utilizes four evaporator assemblies 103. The ice-maker may be operated so that two of the evaporators are making ice while the other two are being harvested, or the design may be such that three are making ice while the remaining evaporator is being harvested. In addition to the components actually illustrated in FIG. 7, the ice-maker includes such other components as illustrated in FIGS. 1 and 5 with respect to the ice-maker 11 but which, for purpose of simplification, are not here repeated.

Of those components which are illustrated, water collectors 105 are provided below each of the evaporator assemblies which are connected by suitable piping to a water reservoir 107 wherein a desired level of water is maintained by a float valve or the like. A pump 109 takes suction from a lower location in the reservoir and continuously supplies water, whenever the ice-maker is operating, to a water distribution manifold 111 located above the evaporator assemblies. The distribution manifold 111 is connected to a plurality of water spray pipes 113 having a series of holes along their length through which a pattern of water is sprayed onto the upper portions of each of the faces of the evaporator assemblies 103. The water then flows downward as a film along the surface with the excess dripping into the collectors 105 whence it is returned to the reservoir. In this embodiment, the water is supplied continuously to the evaporator assemblies, even during harvesting, which has the effect of slightly lessening the time of harvesting of each evaporator assembly, and the ice pieces or cubes which fall from the assemblies are deflected, as explained hereinafter, from the collectors 105 and are received in an underlying chamber 115 which may be a chute leading to the bin or which may be the actual storage bin itself.

Figure 9:
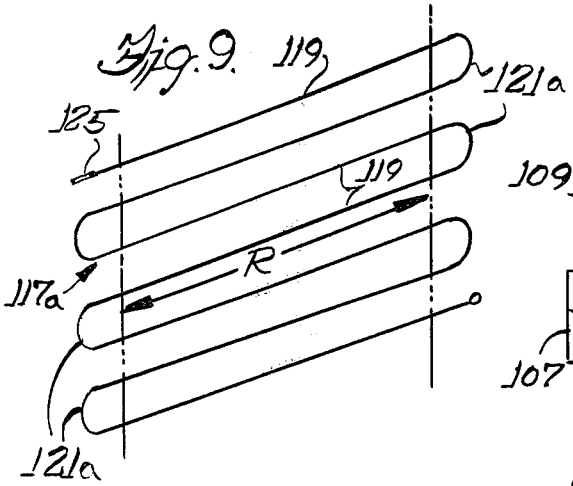
FIG. 9 is a perspective view of one of the metal evaporator coils that is employed in the evaporator assembly illustrated in FIG. 8.
Figure 7:
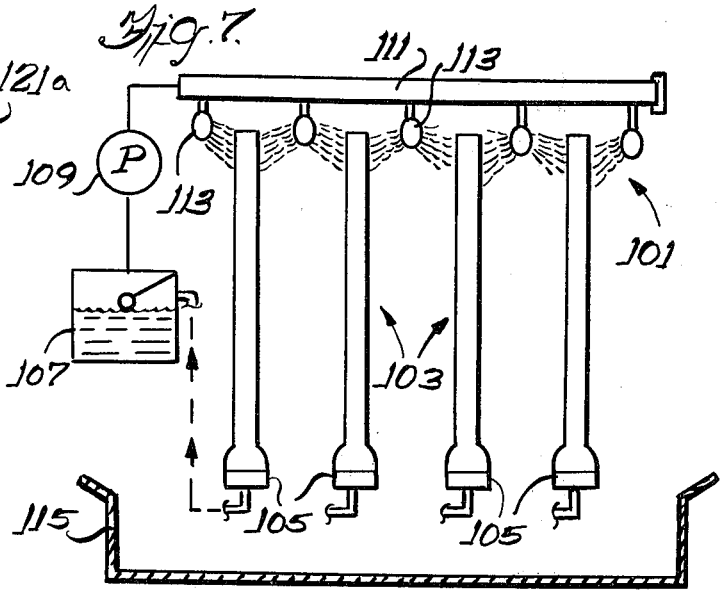
FIG. 7 is a diagrammatic view of an alternative embodiment of an ice-maker embodying various features of the present invention.
Figure 10:
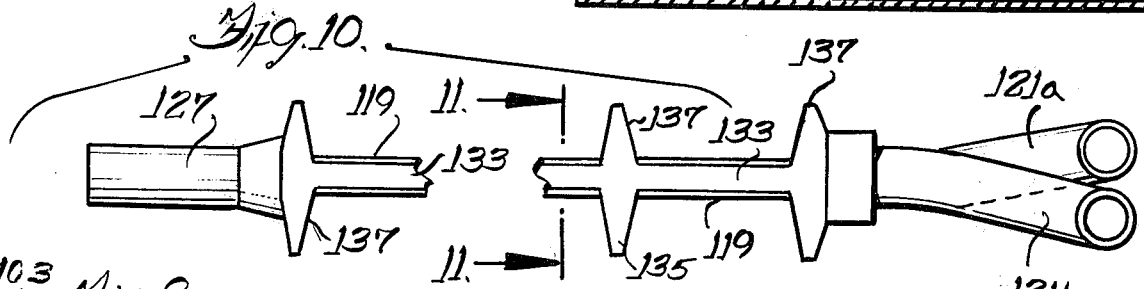
FIG. 10 is a fragmentary sectional view, enlarged in size, taken generally along the line 10—10 of FIG. 8.
Figure 8:
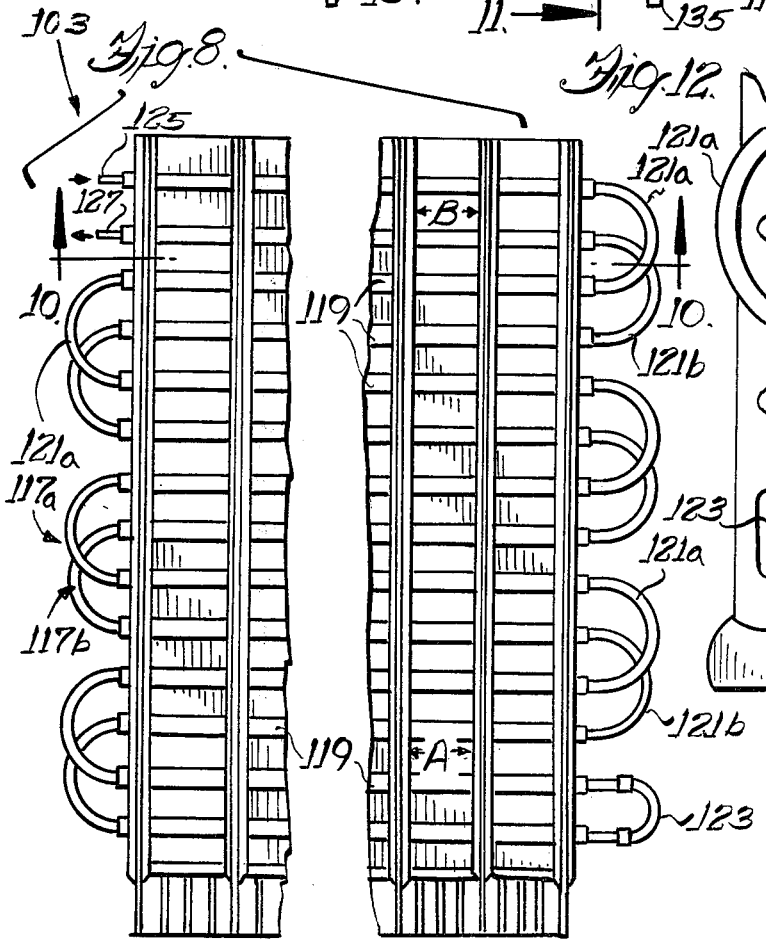
FIG. 8 is an enlarged front view of the evaporator assembly which is employed in the FIG. 7 embodiment.
Figure 12:
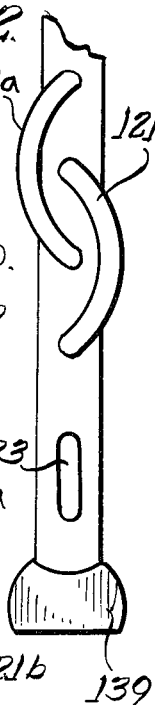
FIG. 12 is a fragmentary side view of the evaporator assembly shown in FIG. 8.

Each evaporator assembly includes a composite metal coil made up from two separate pieces of metal tubing 117*a* and 117*b*. The tubing may be Type 304 Stainless Steel of originally entirely circular cross section, i.e., $\frac{1}{2}$ inch O.D., which has been deformed to have the shape desired. More specifically, the central portion of the metal tubing piece, in the region generally marked R in FIG. 9, is formed to constitute parallel straight segments 119 which are interconnected by curved end sections 121. As best seen in FIG. 12, the end sections 121*a* of the coil section 117*a* are bent in one direction and the end sections 121*b* of the other coil section are bent in the opposite direction so that they will fit together in mating arrangement with all of the central tubing sections 119 aligned in substantially the same plane. The two coil sections 117*a* and 117*b* are interconnected at their lower ends by a U-shaped connector 123. Accordingly, the refrigerant may enter through the inlet end 125 of the coil section 117*a*, travel through the length of it, enter the section 117*b* through the connector 123 and then leave the coil assembly via an exit 127 at the upper end of the coil section 117*b*.

Figure 11:
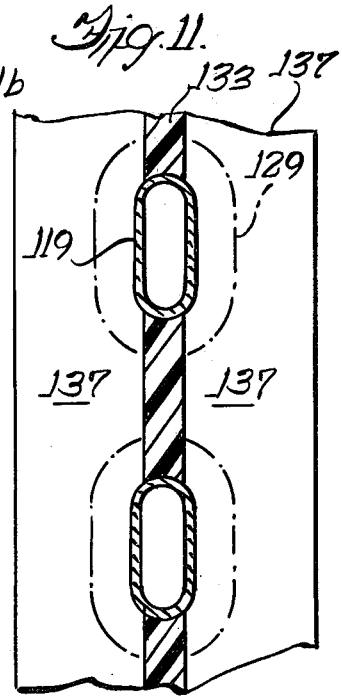
FIG. 11 is a fragmentary sectional view, enlarged in size, taken along the line 11—11 of FIG. 10.

So as to improve the heat transfer characteristics and the shape of the ice pieces, the straight tubing segments 119 are preferably deformed from a circular to an oval cross section as best seen in FIG. 11. The long axes of the oval sections are vertical so that they are aligned generally in a planar arrangement. The deformation of the tubing is such that the longer axis or vertical dimension (about 0.69 in.) is preferably between about two and four times the length of the shorter axis or horizontal dimension (about 0.19) of the oval cross section. The ice cubes or pieces 129 which result from the freezing of water onto the surface of tubing of this type have the shape as shown in phantom outline on FIG. 11 and are preferred for use in the quick-cooling of beverages.

The evaporator assemblies 103 are preferably made by disposing a pair of coil sections 117*a* and *b* as inserts in an injection molding press and then molding a suitable thermoplastic material about the coil sections to provide the overall supporting material which unites the two coil sections as a structural unit. As earlier indicated, a thermoplastic resin, such as high density polypropylene, polytetrafluoroethylene, high density polyethelene or low density polyethylene, is used. Preferably, it should have a thermal conductivity not greater than about that of water ice.

In the ultimate evaporator assembly, the support material constitutes a central generally planar web 133, which is vertical in the operating evaporator and which has a thickness slightly less than the horizontal dimension of the tubing segments 119. Vertical dividers 135 extend from both surfaces of the web 133 for substantially the entire height of the evaporator, and the dividers are generally uniformly laterally spaced from one another so as to determine the length of the ice pieces 129 which will be formed on the short exposed sections of the metal tubing side wall disposed therebetween. To facilitate release of the pieces from the surface of the evaporator during harvesting, the transversely extending surfaces 137 of the divider are formed at an angle of at least about 95° to the web, and preferably between about 100° and about 120°. Preferably the distance A (FIG. 8) between the dividers 135 at the bottom is slightly greater than the comparable distance B at the top to create a positive tendency for the cubes to slip downward. This difference in distance is achieved by forming the dividers so they taper inward or narrow slightly from top to bottom. The bottom portion of the evaporator assembly terminates in a series of aligned, flat spaced apart fins 139 which flare outward from the web a distance greater than the dividers. During harvesting the fins serve to deflect the falling cubes away from the underlying collectors and into the chamber or chute 115 while allowing the water, both during ice-making and during harvesting, to drip downward between the fins into the collectors 105 whence it is recirculated.

The harvesting operation is also carried out by using low-voltage resistance heating to heat the selected evaporator assembly 103 to free the surfaces of the generally half-round ice pieces 129 from the exposed surface of the tubing segment 119 and from the surfaces of the surrounding web 133 and the transverse surfaces 137 of the dividers. Suitable low-voltage current is preferably also supplied from the secondary winding of a transformer to each of the coil sections 117*a* and 117*b*, creating a current flow throughout each of the coil sections which provides the desired amount of resistance heating of the evaporator coil to effect surface melting both adjacent its surface and, by heat conduction through the injection-molded thermoplastic, adjacent the associated surfaces of the webs and the dividers. As previously mentioned, the continuous supply of water during harvesting aids in the release of the ice pieces from the boundary surfaces of the thermoplastic.

The overall control of the freezing and harvesting using the evaporator assemblies 103 is as generally described hereinbefore with respect to the ice-maker 11. Of course, if the four evaporator assemblies are operated so as to harvest sequentially, each of them will be at a slightly different stage of ice-making or harvesting, and the overall control system will be designed to accommodate such operation.

An important feature of the design lies in the low mass of the evaporator assemblies 13 and 103 which requires only a low amount of heat energy to harvest the ice cubes that have been formed on the surfaces of the evaporator. In the first-described embodiment, the employment of the metal clamping rods as auxiliary harvesting heating elements at low voltage provides an effective and unexpected advantage which results from the modular design of inexpensive, injection-molded plastic parts. Annealed and passivated stainless steel tubing, which is useful as a resistance heating element because of its physical characteristics, i.e., an electrical conductivity not greater than about 290 ohns per mil foot, is available at a cost generally less than comparable copper tubing having an acceptable nickel or tin plating. Moreover, if low-voltage heating via both the evaporator coil and the clamping rods is used to provide rapid and economical harvesting, it gives independent control of the precise voltage applied to each of these resistance heating elements by means of the location of the taps on the transformer secondary winding—a further advantage.

Depicted in FIGS. 13 through 17 is another alternative embodiment in the form of an ice-maker 151 which can also utilize a number of evaporator assemblies, as hereinbefore described; however, for ease of explanation, only a single evaporator 153 is generally referred to in the following description inasmuch as all of the evaporators would be constructed in the same manner. Similar to the evaporator assembly 103, the evaporator assembly 153 includes a composite metal coil 155 made up from two separate pieces of metal tubing 155*a* and *b* which have been cold-worked to deform straight segments 157 to the oval cross-section desired and which are interconnected at their lower ends by a U-shaped connector 159. The evaporator assembly is preferably made by disposing a pair of such coil sections 155*a* and *b* as inserts in an injection-molding press and then molding a suitable thermoplastic material thereabout to provide the overall supporting material which unites the two coil sections as a structural unit, using the thermoplastic materials hereinbefore described.

The ultimate evaporator assembly 153 includes a central, generally planar web 161 of synthetic resin, which is vertical in the evaporator and which has a thickness slightly less than the horizontal dimension of the tubing segments 157 (see FIG. 17). For example, the outer dimension of the oval cross-sectional tubing may be about 3/16ths of an inch, and the thickness of the web 161 may be about 80% of that figure.

A significant difference appears in the form of vertical dividers 163 which extend from the top to the bottom of the evaporator assembly 153. The dividers 163 have transverse surfaces 165 which are formed at an angle of about 110° to the plane of the web 161 and are hollow, having generally triangular cross-sectional vertical passageways 167 formed therein, as best seen in FIG. 14. The bottom of each of these hollow vertical passageways 167 is in communication through slots 168 with a lower header 169, of generally trapazoidal cross-section, through which a warm liquid is pumped during harvesting. As shown in FIG. 13, the header 169 has an inlet 171 at its left-hand end through which warm water is pumped during harvesting to heat the synthetic resin material of the dividers 163 to a temperature above the freezing point of water and cause melting at the interface with the ice piece. The water eventually overflows from the top of the hollow passageways 167 (FIG. 16) and then runs down the outer faces of the evaporator, further aiding in harvesting as earlier mentioned.

Referring now to the overall diagrammatic view of the ice-maker 151 shown in FIG. 13, a compressor 173 is provided which takes its suction from an outlet 175 at the upper end of the evaporator coil via line 177. The compressor discharges the hot, high-pressure gaseous refrigerant to a heat exchange coil 179 with which there is associated a fan 181 that is operated when desired and as necessary. A refrigerant receiver 183 is connected to the outlet from the coil 177, and a line 185 leads from the receiver to the evaporator inlet 186. A solenoid-controlled off-on valve 187 is located adjacent the inlet together with a variable flow expansion device 189 which can gradually change the rate of flow, based upon the temperature of the exiting refrigerant detected by a sensor 191 at the outlet line 177, as is well known in the art.

The line 185 leading from the receiver 183 to the evaporator inlet 186 contains a coil 195 that is disposed in a reservoir 197 of water which is heated by the hot liquid refrigerant, as explained hereinafter, to create the warm harvest liquid. A small pump 199 takes suction from the reservoir and delivers the warm harvest water to the inlet 171 to the bottom header. The reservoir 197 is kept filled to a desired level by gravity flow from a main water supply reservoir 201 that is connected through a float valve 203 with a city water supply or the like. Additional pumps would likely be employed to supply warm harvest water to other evaporator assemblies that would form a part of the overall ice-maker.

A sump 205 for holding water for the formation of the ice cubes is provided which is also kept full by gravity flow from the supply reservoir 201. A pump 207 takes suction from the sump and pumps cold water to a pair of distribution manifolds 209 located above the evaporator assembly 153, as best seen in FIG. 15. The water flows downward as a film across both surfaces of the evaporator forming ice where it passes over the surface of the oval tube segments 157. Water which does not freeze reaches the outer surface of the triangular cross-section, bottom header 169 and drips from there into an underlying collector 211 which returns the water by gravity to the sump 205. The shape of the exterior of the bottom header 169 is such that falling pieces of ice are deflected outward from the water collector 211 and into a bin (not shown) disposed there-below, whereas the water droplets follow around the curved surface and drip into the collector.

When the evaporator is operating in the ice-making mode, the solenoid-controlled valve 187 is open, and high-pressure liquid refrigerant is expanded through the variable flow expansion device 189 to lower its temperature below the freezing point of water. If, for example, R-22 is used as the refrigerant, it may be expanded to a pressure about 40 psig. at which its temperature will be at about 20° C. At the same general time, water is pumped from the sump 205 to the water distribution manifolds 209 and sprayed onto both vertical surfaces of the evaporator 153 so as to travel downward as a film to form generally C-shaped ice pieces 213 in the individual regions surrounding the exterior surfaces of the exposed tube segments 157 and as further defined by the adjacent vertical surface of the web 161 and the slanting and preferably, slightly downwardly, diverging surfaces 165 of the dividers. Water reaching the bottom in chilled but unfrozen condition drips into the collector 211 and returns to the sump 205 for recirculation.

A control system 215 is used similar to that generally hereinbefore described which utilizes a timer to control the length of the freezing period. When harvest is ready to begin, the solenoid valve 187 is closed, and the evaporator coil 155 is allowed to dry out. At the same, the pump 207 may be halted so as to stop the supply of water to the top of the evaporator. The pump 199 is actuated to pump warm water, for example at a temperature of about 60° F., through the header inlet 171 and upward through all of the vertical passageways 167 in the dividers. The heat supplied by the warm water raises the temperature of the divider surfaces 165, the adjoining web material and the metal tubing to create melting along the interfaces thereof with the ice pieces 213. At the same time, the water overflows the open ends at the top and flows downward along the outer vertical surfaces of the evaporator to assist in the harvest.

The warm water is cooled during the harvesting process and eventually drips into the collector 211 whence it is transferred to the sump 205. The water is heated in the harvest water reservoir 197 by heat-exchange with the coil 195 containing the warm high-pressure liquid refrigerant from the condenser. Depending upon the temperature of the liquid leaving the condenser 179, the fan 181 is controlled so that condensation occurs in the condenser coil 179 but substantially no subcooling occurs. The water in the reservoir 197 is then heated while subcooling the liquid refrigerant and thus increasing its value as a refrigerant to later absorb heat in ice-making. When R-22 is used as the refrigerant, it may enter the immersed coil 195 at a temperature of about 100° F. and exit at about 70° F. Should the water temperature in the reservoir happen to exceed about 65° F., the fan motor 181 can be controlled to utilize air-cooling to achieve some subcooling of the high-pressure refrigerant in the condenser 179.

After the valve 187 has been closed for a predetermined length of time so that the coil 155 has essentially dried out, the control system 215 causes a valve 217 in the outlet line 177 to close and cause the build-up high-pressure vapor within the evaporator. The increase in pressure in the evaporator is sufficient to cause the tubing segments 157 to flex outward within their elastic limit causing substantially an outward bowing to occur, as depicted in dotted outline in FIG. 17. This constitutes a substantial change in the contour of the original wall surface of the tubing segment as it tries to distend outward to regain its original round configuration. This substantial change in contour of the surface of the tubing segment upon which the ice piece 213 has been formed greatly assists in the harvesting process by causing the ice pieces to break free and fall downward into the underlying bin.

The amount of increase in interior pressure required is of course dependent upon the particular wall thickness and the tubing material from which the evaporator is formed. Usually stainless steel tubing would not be used at a wall thickness greater than about 0.025 inch. For example, if type 304 stainless steel tubing having an original wall thickness of about 0.020 inch and a ½ inch outer diameter is used, it may be flattened to about 3/16ths inch O.D. in forming the oval cross-sectional segments. Flattening effects some cold working of stainless steel tubing that raises its yield stress point and assists in its being able to repeatedly flex within its elastic limit to achieve the desired harvesting purpose without returning to its original circular cross section. Moreover, for tubing having a wall thickness and an O.D. in the aforementioned general range, an increase in the internal pressure of about 75% should be adequate to cause substantial outward deflection sufficient to effect the breaking loose of the ice pieces 213, as illustrated in dotted outline in FIG. 17. When R-22 is used as the refrigerant, its normal pressure is doubled (i.e., to about 80 psig) during the harvest cycle by raising its temperature to about 32° F. in the closed system, which increases the outer horizontal dimension of the tubing segments about 0.004 inch.

When the harvesting is completed, the pump 199 is shut off, and an associated valve (not shown) is operated so as to allow the water in the hollow vertical passageways 167 of the dividers and in the header 169 to drain back into the warm water reservoir 197 so that this water does not turn to ice and block the passageways during the subsequent ice-forming operation. The pump 207 begins to supply water to the distribution manifolds 209 shortly after the main valve 187 is opened to begin to lower the temperature of the evaporator. As earlier indicated, the air circulating fan is controlled to condense, but not subcool, the refrigerant. Overall, this arrangement is conservative of energy inasmuch as the heat for carrying out the harvesting is obtained by utlizing waste heat available in the normal condensation step of a mechanical refrigeration cycle, while at the same time providing additional economy of operation by the subcooling of the liquid refrigerant.

Although the invention has been described with regard to certain preferred embodiments, it should be understood that various modifications and changes as would be obvious to one having the ordinary skill in this art may be made without departing from the scope of the invention which is defined by the appended claims. Particular features of the invention are emphasized in the claims which follow.

What is claimed is:

1. An ice-making machine which includes an evaporator for making pieces of water ice and means for supplying water to said evaporator, which evaporator comprises metal tubing formed to provide a plurality of parallel segments which are vertically aligned and are interconnected at alternate ends to form a coil, central web means made of synthetic resin material disposed between adjacent parallel segments and a plurality of generally parallel dividers having surfaces extending transversely from opposite surfaces of said web means, which dividers are spaced apart to determine the longitudinal dimensions of said ice pieces and have transverse surfaces that are oriented at angles greater than 95° to said web, said dividers being hollow and formed with vertical passageways through which warm water can be circulated to harvest said ice pieces.

2. An ice-making machine using a fluid refirgerant having an evaporator as defined in claim 1, a compressor, a condenser and means for causing water to flow in heat-exchange with the refrigerant after it leaves said condenser and before it is supplied to the evaporator in order to heat the water preparatory to its being circulated through said vertical passageways during harvest.

3. An ice-making machine which includes an evaporator for making pieces of water ice and means for supplying water thereto, which evaporator comprises metal tubing formed to provide a plurality of parallel segments which are interconnected at alternate ends to form a coil, said tubing segments being oval in cross section with a long major axis and a short minor axis, support means made of synthetic resin material having a thermal conductivity not greater than about that of water ice, said support means being molded to said tubing segments to form an evaporator assembly and having web sections extending between adjacent tubing segments and transversely extending vertical rib sections, said long major axis of said oval cross section tubing segments being aligned with the plane of said web section, and the thickness of said web section being smaller than the thickness of said tubing segment minor axis, and a refrigeration system including a compressor and a condensor for causing relatively low-pressure cold refrigerant to flow through said tubing segments during ice-making and including means for causing relatively high-pressure warm refrigerant to flow through said tubing segments during harvesting, whereby when water is supplied to opposite surfaces of said coil-support means assembly and refrigerant passes through said tubing segments, ice pieces are formed upon the exposed surfaces of said tubing segments between adjacent rib sections growing outward in opposite directions and whereby application of higher pressure within said tubing segments causes outward bulging which change in outer contour causes said ice pieces to break loose from the surface of said evaporator during harvesting.

4. An ice-making machine in accordance with claim 3 wherein said rib sections of said support means extend transversely a distance greater than one-half the spacing between adjacent parallel tubing segments.

* * * * *